United States Patent [19]

Chase et al.

[11] 4,001,990

[45] Jan. 11, 1977

[54] PREFABRICATED BUILDING STRUCTURE

[76] Inventors: William P. Chase, 8404 Willis Ave., Panorama City, Calif. 91402; Leon Holloschutz, 8456 Blackburn Ave., Los Angeles, Calif. 90048

[22] Filed: July 23, 1975

[21] Appl. No.: 598,396

[52] U.S. Cl. ..... 52/167; 52/22; 52/90; 52/292; 52/636; 52/169.1; 52/169.11

[51] Int. Cl.[2] ..... E04B 7/00; E04B 1/98; E04H 9/00

[58] Field of Search ..... 52/22, 90, 292, 295, 52/296, 167, 169, 541, 636, 592, 640

[56] References Cited

UNITED STATES PATENTS

| | | | |
|---|---|---|---|
| 1,356,348 | 10/1920 | Evans | 52/592 X |
| 3,350,821 | 11/1967 | Jones | 52/292 X |
| 3,462,897 | 8/1969 | Weinrott | 52/169 R |
| 3,596,419 | 8/1971 | Jalbert | 52/169 X |
| 3,638,377 | 2/1972 | Caspe | 52/167 |
| 3,771,273 | 11/1973 | Brodie | 52/169 X |
| 3,785,108 | 1/1974 | Satchell | 52/640 |
| 3,921,356 | 11/1975 | Hughes | 52/169 R |

FOREIGN PATENTS OR APPLICATIONS

| | | | |
|---|---|---|---|
| 1,064,226 | 8/1959 | Germany | 52/22 |
| 141,280 | 12/1960 | U.S.S.R. | 52/167 |

OTHER PUBLICATIONS

Engineering News–Record, Jan. 9, 1947, pp. 83 & 84, "California Auto–Assembly Building".

Engineering News–Record, Oct. 14, 1954, pp. 30–32, "Reservoir".

*Primary Examiner*—J. Karl Bell

[57] ABSTRACT

An improved economical, easily assembled, prefabricated building structural system is disclosed in which practically no on site construction is necessary as compared with the substantial site preparation necessary in the prior art. Substantially every portion of the main structure may be prefabricated on or off site, prior to assembly. The system is characterized in the use of materials which render it fireproof, weatherproof and termite proof and not subject to buckling or warping. It has structural details and connections at the footings, floor slab, vertical columns, roof trusses and interior and exterior walls, for example, which render the finished structure flood and earthquake resistant and give it a life expectancy far superior to prior art prefabricated or conventional housing. Thus, the floor slab, of prefabricated sections, is supported elevated off the ground, on piers set in footings which may be positioned well below moisture and freeze lines; vertical columns and trusses are non-rigidly connected to provide for slight movement, if necessary, for resisting earthquake shock and settling and other aging damage; and floor slab, side walls, and roof panels are all of precast concrete or similar materials to provide insect and weather resistance and to provide an integrated building structural system of extremely solid construction, having a longer life expectance than prior art prefabricated housing or conventional housing.

31 Claims, 28 Drawing Figures

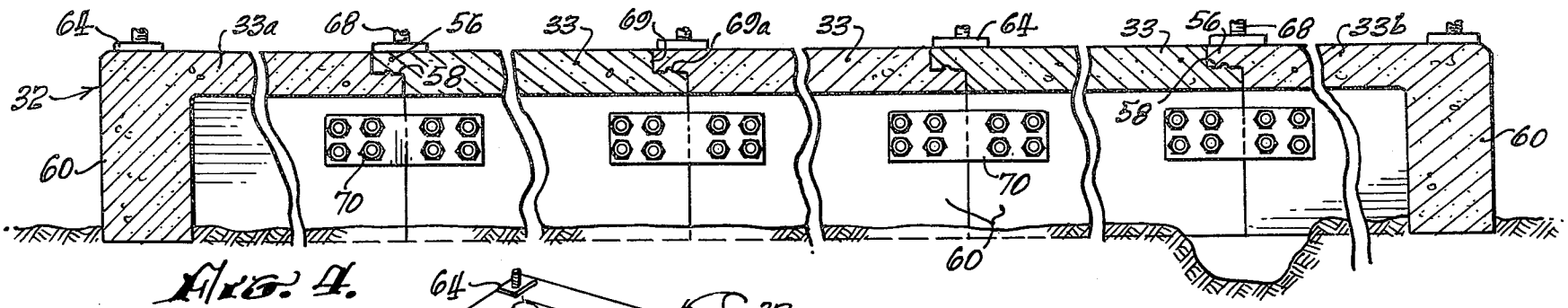
Fig. 4.
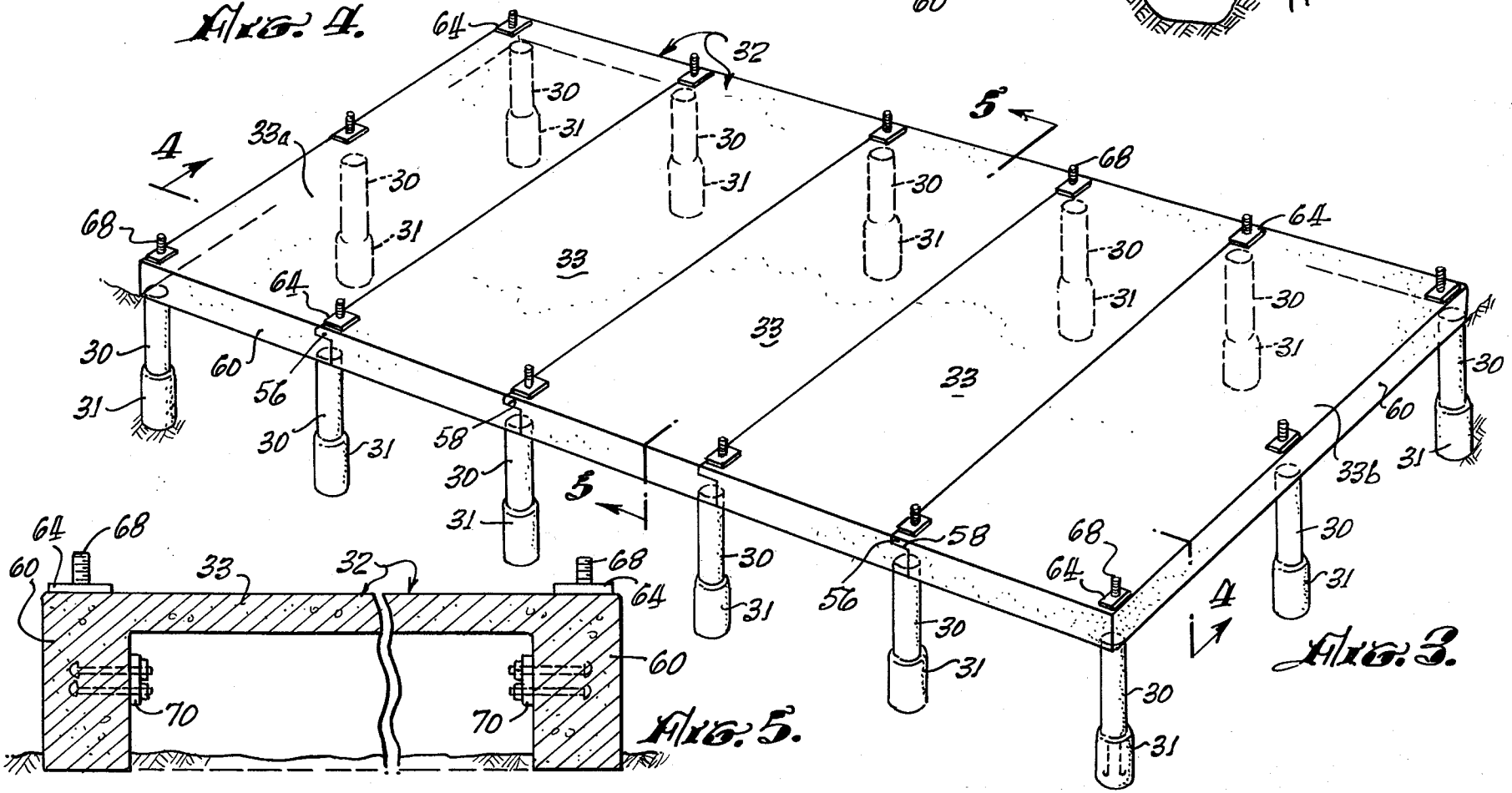
Fig. 3.
Fig. 5.

86
34
32
33a
76
72
126
9
10
11
71
74
64
66
68
67
69
56
69a
58
60
33
62
49
48
50
30
31
51

15
15
46
39
38
118
116
122
110
105
104
37
87
91
37a
93
88
36
34
86
120
112
89
90
92
108
106
68
76
72
71
32
64
74
33a

PREFABRICATED BUILDING STRUCTURE

BACKGROUND OF THE INVENTION

1. Field of the Invention

This invention relates to the building industry. More particularly, the invention relates to improved prefabricated building structural systems.

2. Description of the prior art

In the recent history of the building industry in the United States there has been a considerable effort made to provide economical prefabricated structures. The purpose, of course, was to achieve economy through standardization and to permit construction of a structure with lesser use of labor on the site.

However, prior to the present invention, such efforts have met only with modest success, for several reasons. In the first place, even though purporting to be prefabricated buildings, a good deal of non-prefabricated on-site construction was necessary, as, for example, the preparation for and the placing of footings and floor slabs. Secondly, it has been typical of prior art prefabricated building structures that they have not been weatherproof and have been subject to shocks and weather damage due to the rigidity of the structures and the nature of materials and connections used. Accordingly, such structures have been expensive to build, by virtue of on-site labor costs and have not had a good record of structural soundness or longevity.

OBJECTS AND SUMMARY OF THE INVENTION

Thus, an object of the invention is to provide novel prefabricated building structures which are economical, easy to assemble, and structurally capable of resisting shock, weather, termites and the like.

A further object of the invention is to provide a prefabricated building structure requiring a minimum of on-site preparation costs.

Another object of the invention is to provide a prefabricated building structure in which the floor slab is comprised of prefabricated panels supported on prefabricated piers to render unnecessary the expensive prior art practice of preparing the site and placing a floor slab.

Still another object of the present invention is to provide a prefabricated building in which vertical columns are resiliently supported in order to give the assembled structure the ability to withstand shock without buckling, warping or cracking.

Yet another object of the invention is to provide roof trusses of great structural strength which nevertheless have provisions for relative movement of elements to accommodate movements of the structure caused by shock, settling, or the like.

Another object of the invention is to provide novel means for attachment of prefabricated wall panel sections to the vertical columns of the structure.

A still further object is to provide an integrated prefabricated building structure system characterized in that assembly is simple and economical, in that minimal site preparation is required, and in that the assembled structure, while of improved strength and durability is nevertheless capable of small relative movements of components, without damage, to accommodate for shock, settling or the like.

The objects are realized by providing an integrated building structure system which, from supporting piers to roof, is entirely comprised of prefabricated parts which are economically made and easily and economically assembled, and in which various of the structural elements are connected in a manner to provide some resilience to allow accommodation to slight relative movements within the structure after assembly.

These and many other objects and attendant advantages of the invention will become readily apparent and the invention will become better understood by reference to the following detailed description when considered in conjunction with the accompanying drawings.

BRIEF DESCRIPTION OF THE DRAWINGS

FIG. 3 is a perspective view of the supporting piers and floor slab of the house of FIG. 1.

FIG. 4 is a fragmentary enlarged sectional view of the floor slab taken along the line 4—4 of FIG. 3.

FIG. 5 is a view similar to FIG. 4, taken along the line 5—5 of FIG. 3.

DESCRIPTION OF THE PREFERRED EMBODIMENTS

Figure 1:
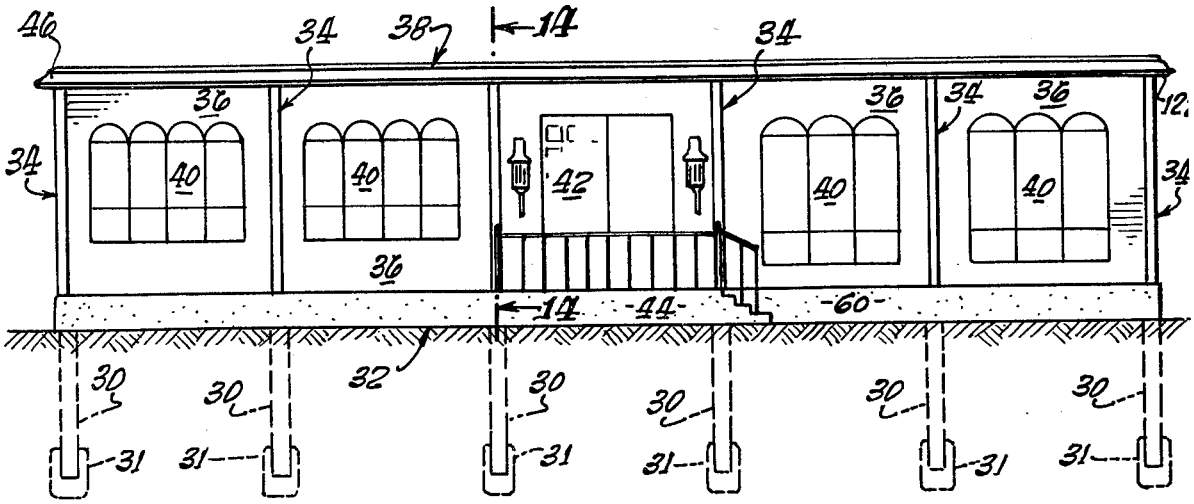
FIG. 1 is a front elevation of a typical house according to the present invention.
Figure 2:
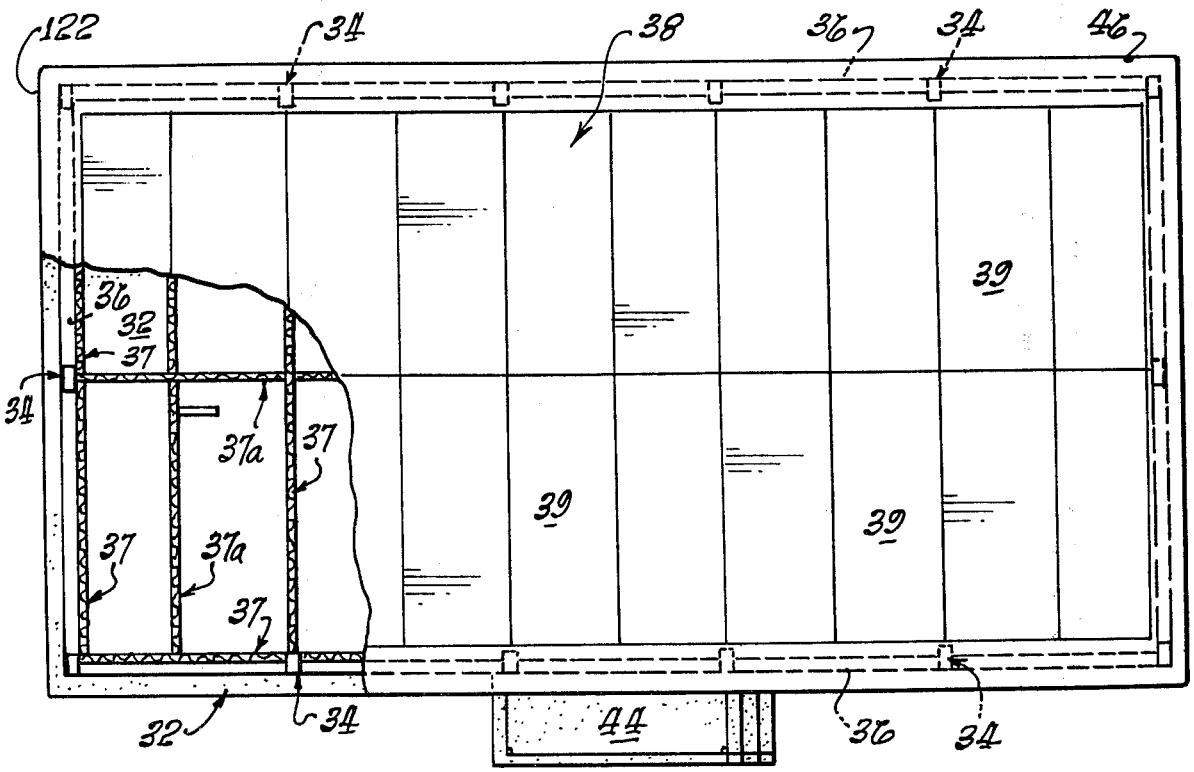
FIG. 2 is a top view of the house of FIG. 1, with parts broken away to show roof truss and internal wall structure.

The entire building structure system of the present invention is illustrated in front elevation in FIG. 1 of the drawings and in a top view in FIG. 2. In general terms, the novel building structure is comprised almost entirely of prefabricated parts. Particularly the outer shell of the building may be formed entirely of prefabricated parts which by virtue of the cooperative novelty thereof, may be easily constructed, with minimal labor on site, in an economical arrangement which can provide fireproof, weatherproof, shockproof, and insect proof building structure. The novel building shell structure is such that all interior trim may be of metal or other suitable fireproof material and may be cast into the material of prefabricated interior and exterior walls. The main structural elements of the external building shell of the building of the present invention are piers 30, adapted to be set in appropriate footings 31, a floor slab 32, vertical columns 34, exterior wall panels 36, roof trusses 37, and a roof slab 38. As shown in FIG. 1, the exterior wall panels may be provided with windows 40 or doors 42 in any desired size and shape, and a porch may be included, as at 44, if desired. The roof may be finished with ornamental flashing, as at 46, if desired. The details of each of the structural components will be described herein since the cooperative relationship of such details contribute to the novel prefabricated building structure system of the present invention.

THE FLOOR SLAB

The foundation and floor slab structure of the present invention are such as to permit total prefabrication either on or off the site to provide economies over prior art prefabricated (and conventional) building practice utilized in setting foundations and floor slabs and yet to provide structural advantages favorably comparable to conventional non-prefabricated structures. Thus, in the practice of the present invention, the floor slab 32 is supported by prefabricated piers 30 and consists of prefabricated floor slab panels which may be of any size. Typically, the floor slab panels may be 10 feet by 26 feet, to give an example of one application of the present invention. In the illustration in the drawings five such slabs are shown to provide a floor slab area of 1300 square feet.

The piers 30 each comprise a precast concrete column which may be of any desired cross section and length, as will be later discussed herein. In the fabrication of each column an internally threaded tubular steel sleeve 48 is embedded centrally longitudinally of the column with one end of the sleeve flush with an end of the column. Sleeves 48 are provided with anchor projections 49 for embedment in the concrete to prevent relative movement after curing. Reinforcing steel bars 50, two to four in number, are welded to the bottom of each sleeve 48, longitudinarlly of the columns and extending through and beyond the ends of the columns opposite to that holding the sleeve 48. Bars 50 are bent outwardly, as at 51, to provide reinforcement and anchors for retention in footings 31.

Figure 28:
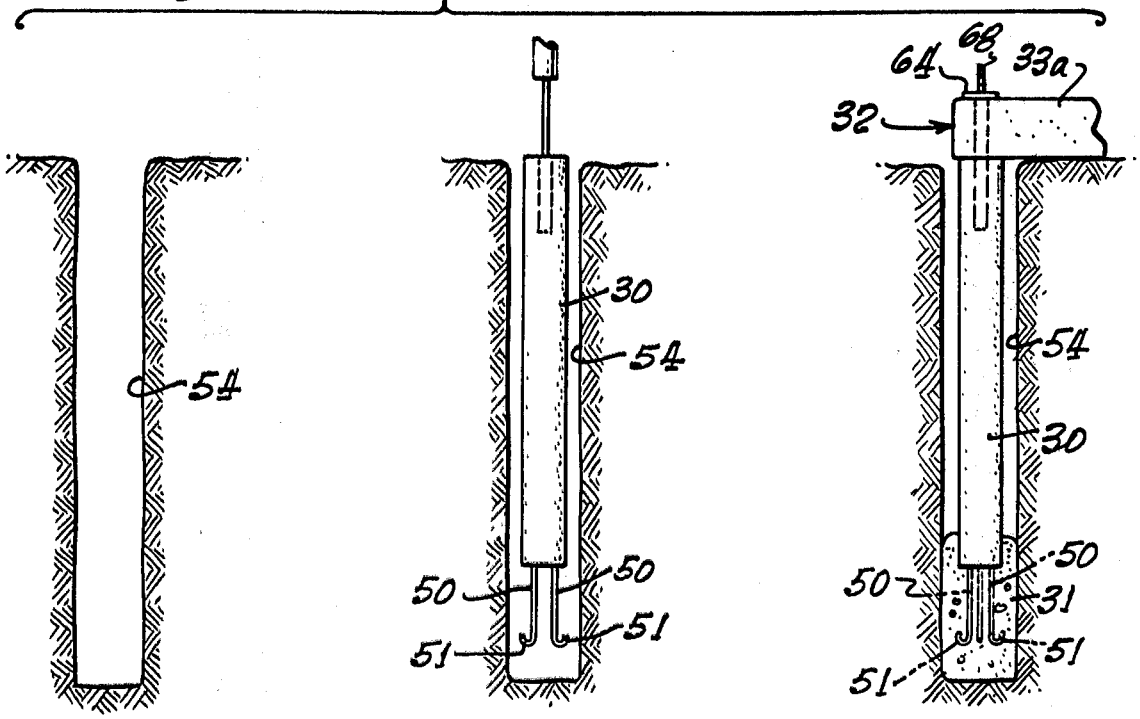
FIG. 28 is a schematic showing of the procedures utilized in setting the floor slab supporting piers of the present invention.

In the practice of the present invention piers as described in the preceding paragraphs may be prefabricated, of concrete, in molds, either on or off the site. They may be of any cross-section and are typically cylindrical in form, for ease of installation. The length of the piers can be as desired but, in the practice of the present invention, it is contemplated that they be long enough to permit setting at least 6 feet below ground level so that the footings are below both frost and flood levels to provide floor slab structures not susceptible to frost and flood damage. Such piers may be placed by procedures requiring a minimum of site preparation. Thus, after leveling of the site, an augur is utilized to drill out pier reception holes as shown in dotted lines at 54 in FIG. 28. An appropriate number of such holes are drilled out, in the desired pattern. In the exemplary showing of the drawing, 14 such holes are required, in a rectangular pattern as shown. A single pier 30 is positioned in each hole and a footing 31 is placed. The piers are, of course, aligned and the tops thereof leveled with one another. After the footings 31 have set, soil is solidly tamped around each pier.

As previously broadly described, the floor slab, generally designated 32, is comprised of separate rectangular interfitting panels which are attached to one another and to the piers to form a unitary floor slab. Specifically the panels include center panels 33 and end panels 33*a* and 33*b*, of desired area and thickness. Typically such panels are several inches thick and of reinforced concrete. In the illustrative example they are of 10 by 26 feet in area. The center panels 33 are identical with one another and are each provided with an overhanging flange 56 along one longitudinal edge and a matching ledge 58 along the opposite edge to provide ship lap joints when the panels are assembled, as shown in the drawings. The side edges of each panel are provided with downwardly extending concrete beam portions 60. End panels 33*a* and 33*b* are similar to one another in that each has a longitudinal beam 60 along one longitudinal edge to form a downwardly extending peripheral thickened beam to close in the air space provided by the assembled slab. They differ in that end panel 33*a* (shown at the left hand side of FIG. 4) terminates in a ledge 58 whereas the other end panel 33*b* terminates in a flange 56 to permit assembly and sealing of the floor slab.

Figure 11:
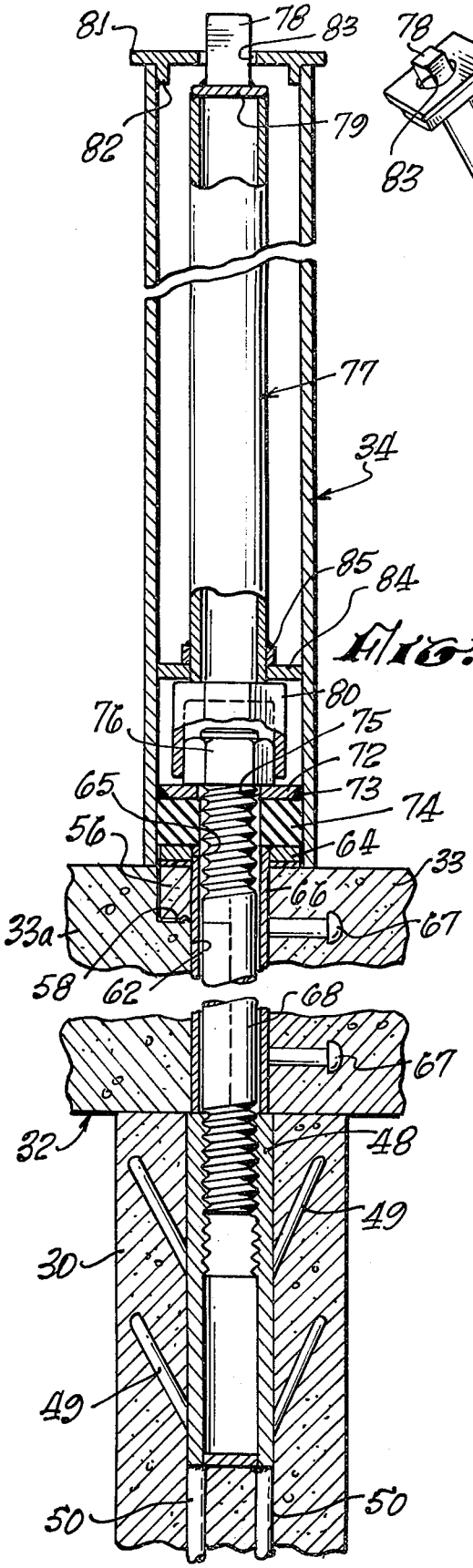
FIG. 11 is an enlarged section taken along the line 11—11 of FIG. 10 including also a nut tightening tool which may be used to tighten the securing nuts which anchor the columns to the floor slab, with some parts shown in elevation and others broken away for clarity of illustration.

The panels 33, 33*a* and 33*b*, by virtue of the complementary flanges 56 and ledges 58, are adapted to be fitted together to form a unitary monolithic floor slab. In the practice of the present invention each panel, in the prefabrication, is provided with means permitting attachment to the piers 30. Thus, the thickened beam 60 of each of the center panels, adjacent each corner, is precast to provide half of a cylindrical opening, 62, as perhaps best seen in FIG. 7, with continuation to a full cylindrical portion in overhangs 56, so that when adjacent panels are mated, a cylindrical hole is provided, through the beam portions to the pier which is to be positioned below. A rectangular steel plate 64 is embedded adjacent the outer and longitudinal edges of each overhang 56, as shown, the plate having a circular bolt receiving opening 65. If desired steel tubing as at 66 may be welded to plates 64 and anchored as at 67 in overhangs or ledges 56, as shown in FIG. 11, rather than simple provision of a semicylinder as previously described. Alternative tube structure 66, 67 is also shown in dotted lines in FIGS. 6, 7 and 8.

Figure 6:
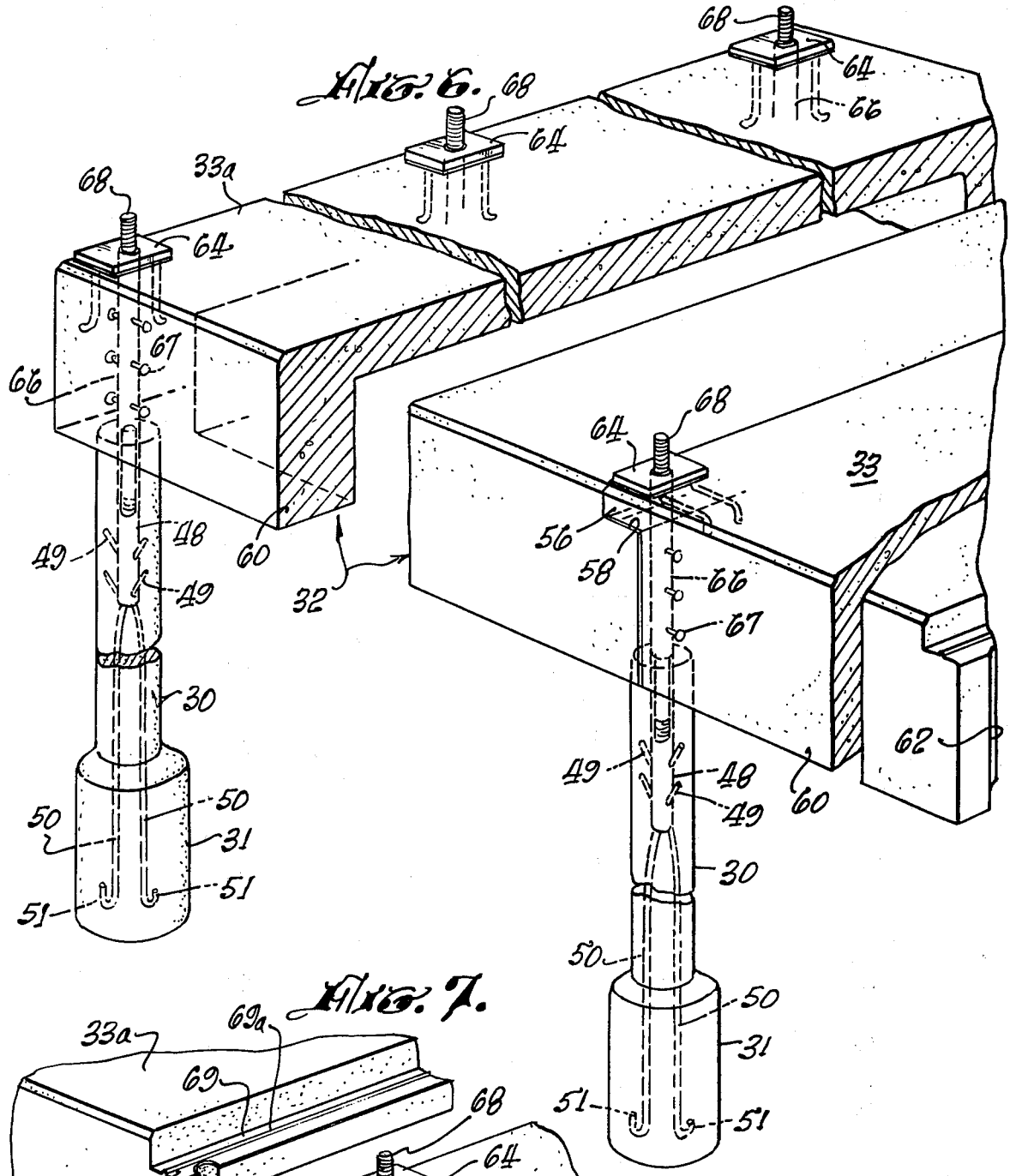
FIG. 6 is an enlarged fragmentary perspective, with parts broken away and shown in phantom lines, illustrating details of the relationship of the floor slab panels to their supporting piers.
Figure 7:
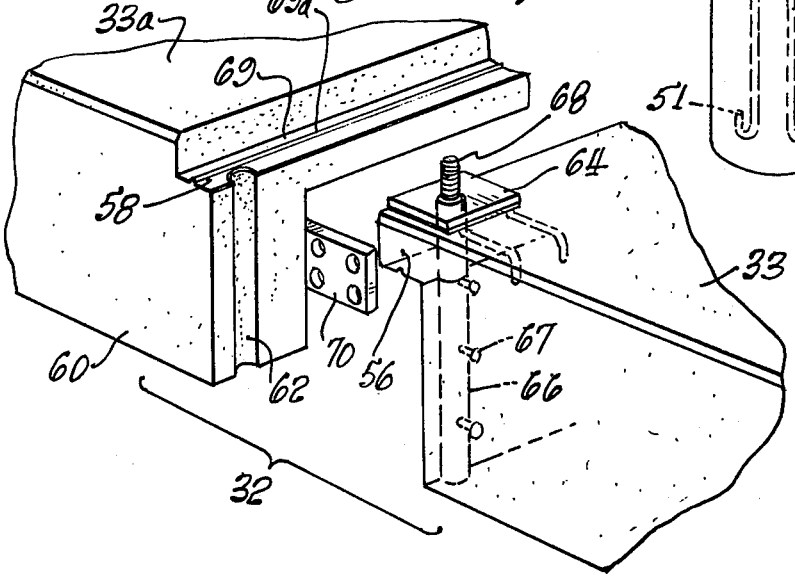
FIG. 7 is an enlarged fragmentary sectional exploded view illustrating details of floor slab panel interengagement and securement means.

The outer edges of the end floor slab panels 33*a* and 33*b* are provided with embedded plates 64 and either circular passages or tubular sleeves or tubes 66, as best seen in FIG. 6. The positioning of the cylindrical passages and the orientation of the rectangular plates 64 is preferably such that edges of the plates are aligned with the floor slab edges, this feature being best shown in FIGS. 3, 6, 7 and 8 of the drawings.

Assembly of the floor slab is accomplished by setting the piers 30, as previously described, in the desired pattern and spacing. A threaded rod 68 is then threaded into the sleeve 48 of each pier 30, the rod 68 being threaded at least at its ends, as shown, and inserted a desired distance into threaded sleeve 48, and being of a length to extend through a floor slab panel (see FIG. 11). Floor slab panels 33*a*, 33 and 33*b* are then serially lifted into position over the piers 30 with the ledges 58 and flanges 56 interfitting to form a ship lap joint and to form passages 62, (or alternatively a passage 62 and a sleeve 66) aligned with the internally threaded sleeves 48 in piers 30, the extending ends of rods 68 serving as centering guides. If desired, metal sheathing may be used to cover ledges 58 and flanges 56 in transit and may be left in place during assembly as shown at 69 (FIG. 7) and augmented with a sealant to further insure a fully sealed floor slab structure. Further improved sealing and positioning may be effected by provision of ribs 69*a*. To further insure the integrity of the unitary floor slab structure connector plates 70 may be provided, if desired, and secured upon threaded studs appropriately placed in the beams 60 of the floor panels adjacent the longitudinal edges of such panels as best shown in FIG. 4. Typically, the floor slab assembly is constructed starting at one end, as with panel 33*b* (see FIG. 3). After positioning of the next adjacent panel 33, connector plates 70 are positioned and tightened across the lines of abutment of the two panels. Access is in the crawl space provided by the elevation provided by the edge beams 60 of the floor panels. At the other end, access to the last to be tightened connector plates is provided by the digging of an access hole under the beam portion, in a convenient place.

Plates 64 are of metal, of rectangular shape, and of a size to fit within tubular metallic vertical columns, as will be later described. In the example shown the plates 64 are of steel, have dimensions of 3½ inches by 5½ inches and are about ½ inch thick. They serve as anchor plates against which a nut could be tightened to secure the fully assembled floor slab. However, in the overall building structure system of the present invention it is desirable to use the same securement and anchor plate elements to also position and secure the vertical columns of the building, as will be described hereinafter.

For purposes not related to construction of the floor slab the floor panels 33, 33*a*, 33*b* may be provided with guides or fins 71 adjacent the edges which will form the outer perimeter of the floor slab. Fins 71 serve the purpose of positioning and anchoring the bottoms of the exterior wall panels of the building structure. Fins 71 are of steel plate of appropriate strength and thickness and may be attached to the surfaces of the floor slab panels in any desirable manner, as by embedment in the panel in the molding thereof (see FIG. 8) or by "shooting" fasteners into the cured concrete (see FIG. 23). The details of fins 71 and their cooperative function in connection with the exterior walls of the building will be described hereinafter.

THE VERTICAL COLUMNS

The vertical columns of the present invention are characterized in that they are anchored to the floor slab by means which provide resilience at the point of connection to the floor slab to accommodate slight relative movement, whereby the building structure may better resist shock, settling or the like. In the specific preferred embodiment shown in the drawings vertical columns 34 are shown as being of tubular metallic construction, having a rectangular cross-section. In the example given the columns have external dimensions of 4 inches by 6 inches and cooperate with anchor plates 64. Such configurations have strengths far exceeding that of wooden columns and are not subject to the known disadvantages (warping, rotting, termites, etc.) of wood. However, the dimensions and materials may obviously be varied as desired, within the scope of the present invention.

Figure 13:
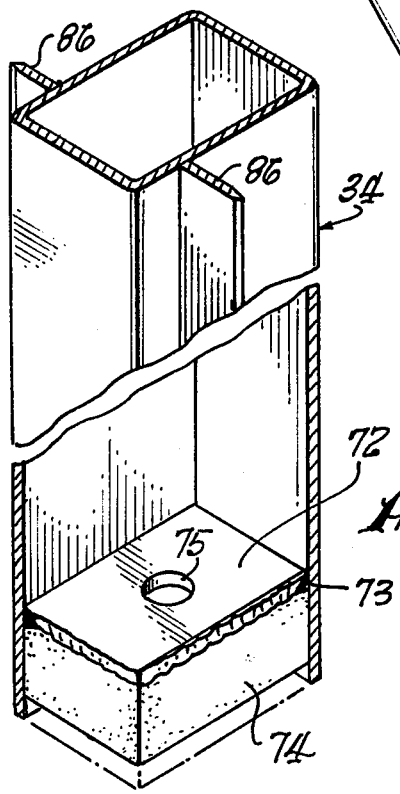
FIG. 13 is an enlarged fragmentary sectional view of the bottom portion of a vertical column illustrating the resilient base pad detail of the column, parts being broken away for clarity.

One end, the bottom, of each column is provided with structure for resiliently positioning and attaching it to the floor slab 32. Such structure is best illustrated in FIGS. 8, 9, 10, 11 and 13 of the drawings and comprises a plate 72 and a rubber pad 74. The plate 72 is of a size to fit internally of the column and is welded into position as at 73 around its entire perimeter. The rubber pad is of appropriate thickness and strength to provide a resilient support and may be attached to the underside of plate 72 with a suitable adhesive to keep it in place during transit and emplacement. Typically, such rubber pads may be about 4 inches thick. The spacing and thickness of the plate and rubber pad are such as to provide a pocket in the end of the assembly as best seen in FIG. 13, to receive a plate 64 for positioning the column and for securement of the column to the floor slab. The plates 72 and pads 74 have a central aperture or passage 75 to accommodate threaded rods 68 extending upwardly from the piers 30 through the skirts 32 of the floor slab panels.

Attention is directed to the schematic showing in FIG. 3, of the orientation of anchor plates 64 in an assembled floor slab. The rectangular plates 64 are oriented so that they all face in the same direction, with one edge coinciding with an edge of the floor slab so that positioning of the vertical columns on the plates 64 will result in the exterior surfaces of all columns being aligned with one another, substantially coincident with the exterior floor slab edges.

The vertical columns are positioned and secured in the building structure as best shown, in detail, in FIG. 11. Each column is positioned over a pier, with an anchor plate 64 in the pocket provided in the end of the column under the rubber pad 74. Accordingly the aperture 75 in the pad 74 and plate 72 is aligned with and receives a threaded rod 68, the plate and rod serving to position and orient the column in the structure. A nut 76 is threaded over the exposed end of the rod 68 to tightly secure the column in place.

Figure 12:
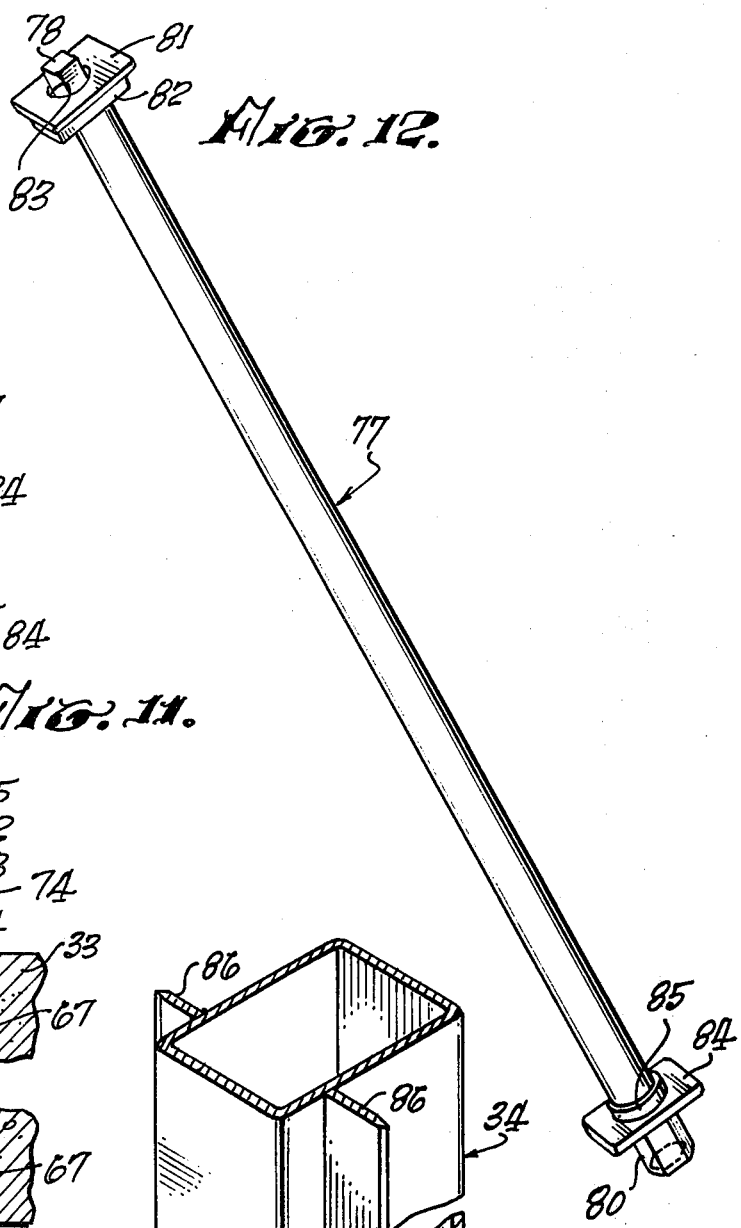
FIG. 12 is a perspective view of the nut tightening tool shown in FIG. 11.

FIG. 12 illustrates a special tool which may be utilized to effect the threaded connection of nut 76 to rod 68 from the opposite end of the column, which might be, for example, 10 feet 4 inches long. Such a tool may comprise a heavy pipe 77 of appropriate diameter, smaller than the smallest dimension of the cross-section of columns 34. The pipe is provided with a wrenching lug 78 suitably attached to one end thereof, as by welding to plate 79 which may in turn be welded to the pipe 77 at one end. The opposite end of the wrenching tool is provided with a socket 80 to receive a nut 76. The socket may be attached to the pipe in any suitable manner, as by welding. The tool is of such a length that wrenching lug 78 extends from the top of a column when the tool is inserted therein for tightening a nut 76. The wrenching tool is centered by provision of a cap 81 at the outer end of shell 77, the cap having downwardly extending flanges 82 arranged in a rectangle of a size to fit internally of column 34 as shown in FIG. 11. A central aperture 83 is provided in the cap 81 so that the wrenching lug 78 may be centered and exposed for application of a wrench. The inner bottom end of the pipe 77 is provided with centering means so that insertion of the tube will align a nut retained in the socket 80 with the threaded rod 68. For this purpose pipe 77 is provided with a guide plate 84 which is rectangular in perimeter and of dimension to snugly fit the inside of a column 34. Plate 84 has a central circular aperture to accommodate pipe 77 for relative rotation therein and is retained adjacent the socket at the bottom of tube 77 by retaining collar 85 welded to the pipe 77, all as best shown in FIG. 12.

Assembly of a column is effected by positioning it over a plate 64 with a rod 68 extending through the aperture 75 in rubber pad 74 and plate 72. A nut 76 is placed in socket 80 (retained either frictionally, or magnetically). The tool 77 is then inserted in the column, guide plate 84 functioning to center the nut over the rod 68. The cap 81 is positioned over the upper end of the column to fully position and orient the wrenching tool. A wrench is then applied to the lug 78 to tighten the nut 76 as desired. Obviously, other means such as access openings, flexible shaft tools, or the like could be used. The specific tool described herein is merely a preferred example of means which could be used.

Columns 34 when constructed and connected as described herein contribute to building structures of superior strength which are particularly resistant to damage by earthquake, shock, settling or the like, since the connections to the solid monolithic floor slab are resilient so that slight movement can be accommodated rather than the buckling or cracking which is typical of prior art prefabricated and conventional structures.

Figures 8, 9, 10:
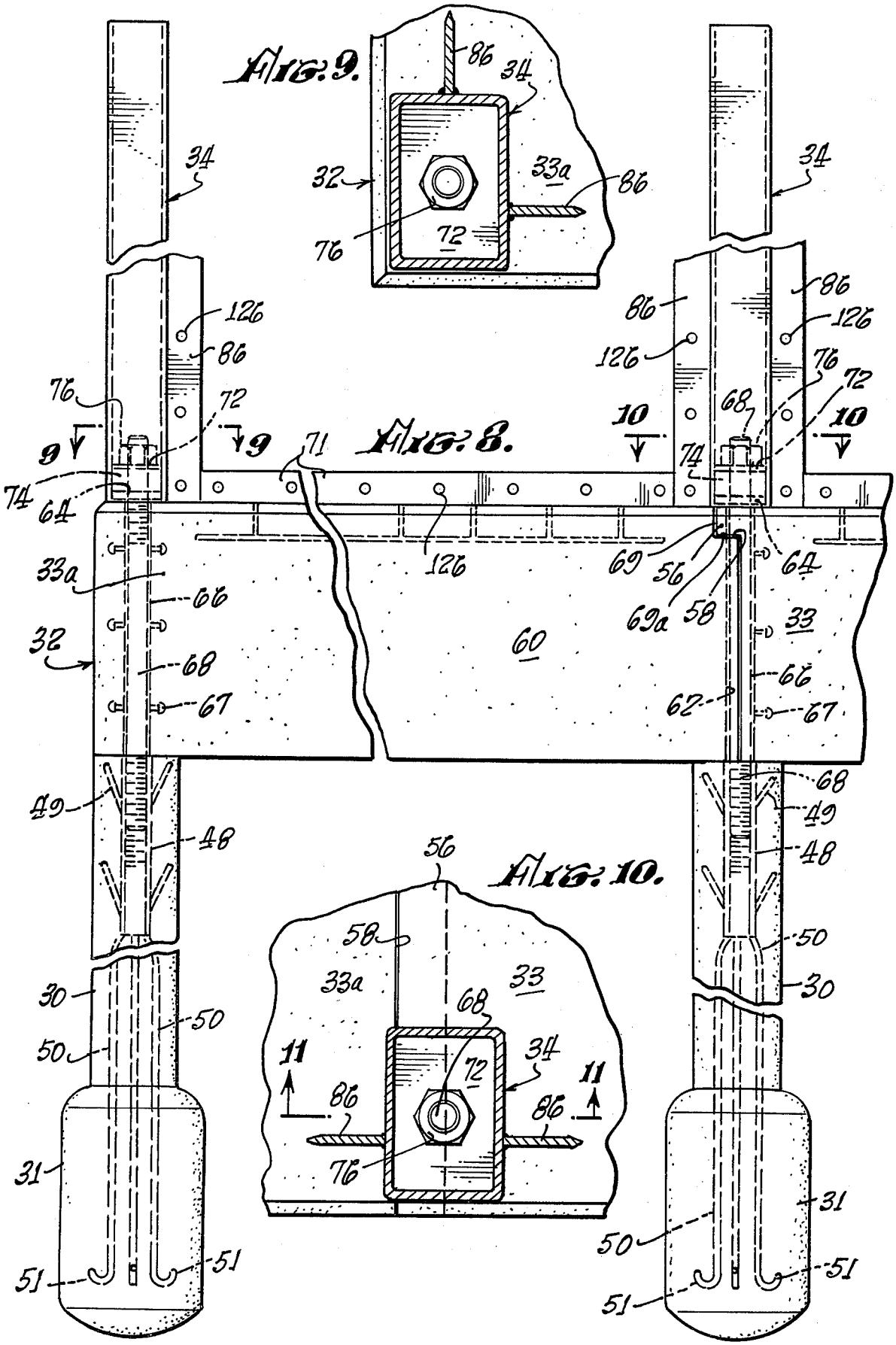
FIG. 8 is an elevational view with some parts broken away for clarity of illustration, showing details of the vertical columns of the novel building construction and of the means of connection thereof to the floor slab.
FIG. 9 is an enlarged fragmentary section taken along the line 9—9 of FIG. 8, showing details of a corner column.
FIG. 10 is an enlarged fragmentary section taken along the line 10—10 of FIG. 8 showing details of a side column.

Attention is directed to the fact that columns 34 are provided with integral fins 86 positioned along the length of at least two sides thereof for securement of the exterior wall panels 36 as will be described in detail hereinafter. Fins 86 are best shown in FIGS. 9 and 10, FIG. 9 depicting a corner column arrangement and in FIG. 10 illustrating the fin disposition for columns other than corner columns.

ROOF TRUSS STRUCTURES

It is an important feature of the present invention that roof truss structures are provided which combine great structural strength with a capability to accommodate and permit some degree of relative movement of truss components and building elements to which they are attached. Such arrangements overcome the disadvantages of the inflexible relative immobility of prior art conventional and prefabricated building structures. Thus, the relatively movable components of the truss components of the present invention permit adaptation of roof trusses, vertical columns and walls to slight relative movement due to earthquake, shock, settling, or the like with much less danger of buckling or cracking than in conventional structures. This is accomplished, in several embodiments of the present invention, by utilizing connections for the truss webs which provide for relative pivotal movement so that the top and bottom chords can, if necessary, shift slightly relative to one another to accommodate movements caused by shock, settling, or the like. Trusses according to this invention may take several forms, all of which provide the pivotal web connections mentioned herein, and may have either metal or wooden top and bottom chord beams.

Figures 14, 15, 16, 17, 18:
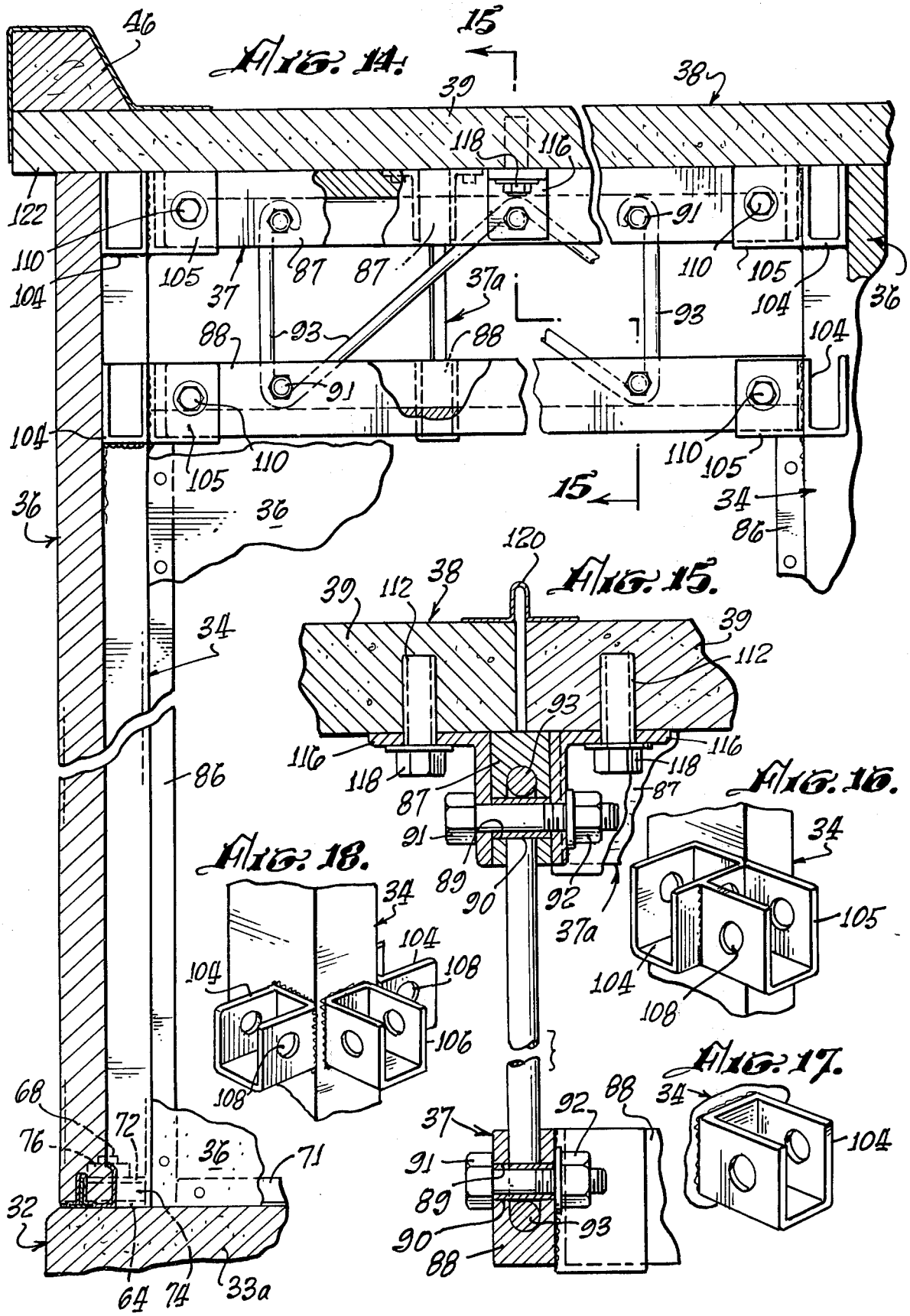
FIG. 14 is a fragmentary sectional view, with parts broken away taken along the line 14—14 of FIG. 1, illustrating an embodiment of a metallic roof truss structure, the mode of attachment thereof to vertical columns and roof slab panels, and the relationship to exterior wall panels which extend to the roof.
FIG. 15 is an enlarged fragmentary sectional view, taken along the line 15—15 of FIG. 14.
FIG. 16 is an enlarged fragmentary perspective view of bracket or hanger means utilized at corner vertical columns for supporting the ends of the chords of truss members in the roof truss embodiment of FIG. 14.
FIG. 17 is a view similar to FIG. 16 illustrating a single truss supporting bracket.
FIG. 18 is a view similar to FIG. 16, illustrating a bracket or hanger arrangement as required for intermediate vertical columns.

A preferred embodiment of roof truss according to this invention is shown in FIGS. 14 to 19 and comprises top and bottom chord members 87, 88 formed of strong, lightweight steel channel. The extending shoulders of the channel-shaped chords are provided with aligned bolt holes, as at 89, and sleeves 90 are inserted therein, if desired, to provide rotational freedom for bolts 91, secured by nuts 92, as best seen in FIG. 15. The bolt holes in top and bottom chords 87, 88 are arranged to have vertical alignment adjacent the ends of the chords and a zig-zag pattern between such vertically aligned bolt holes, as best seen in FIG. 14.

A single length of steel rod 93, of a configuration providing a zig-zag pattern between parallel vertical end portions is positioned between the top and bottom chord members, internally of the shoulders of the channel, with each point formed by the zig-zag shape extending around a sleeve 90, as clearly shown in FIGS. 14 and 15 to form the web of the truss. Ideally such truss member would be assembled of prefabricated and bored channels and preshaped rods either at the factory or on site by positioning the single shaped rod in the top and bottom chord members and then inserting sleeves 90, bolts 91 and nuts 92 to hold the web in place.

It should be noted that, if such structures are assembled off site, they can easily be folded for transportation to the site. The resulting structure provides the typical triangular ties utilized in roof trusses, in a simple, economical arrangement which has the advantages of accommodation to slight movements which have been previously discussed.

Figure 20:
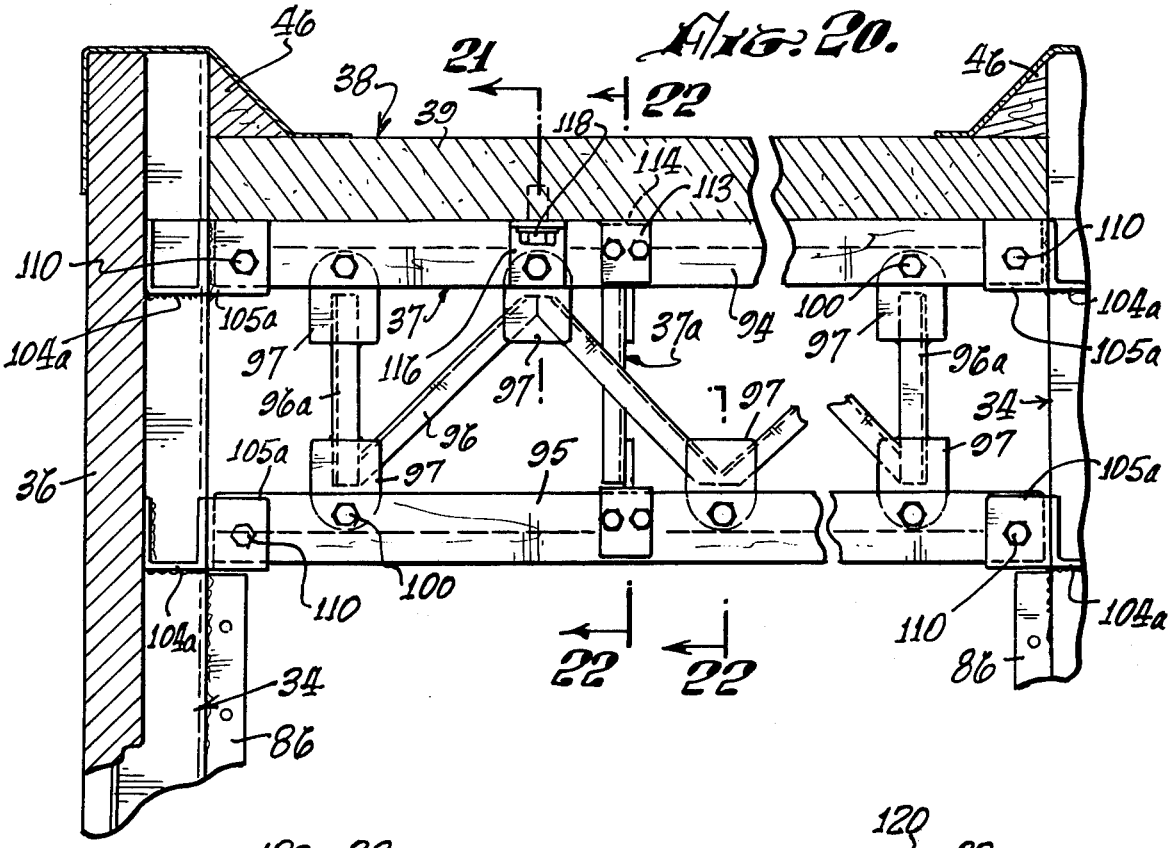
FIG. 20 is a view similar to FIG. 14 illustrating a truss structure utilizing wooden chords as applied to exterior walls which enclose the roof trusses and extend to the roof.
Figure 21:
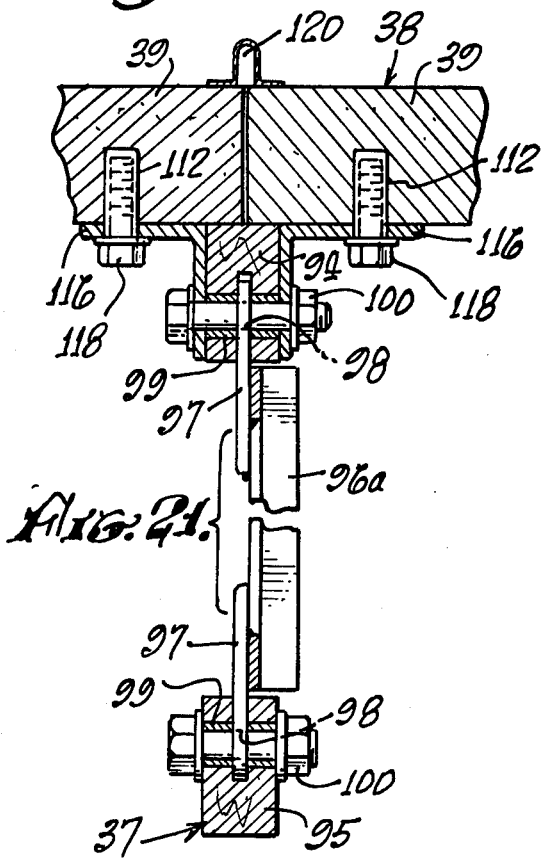
FIG. 21 is an enlarged fragmentary sectional view taken along the line 21—21 of FIG. 20, illustrating details of truss and roof securement structure.
Figure 22:
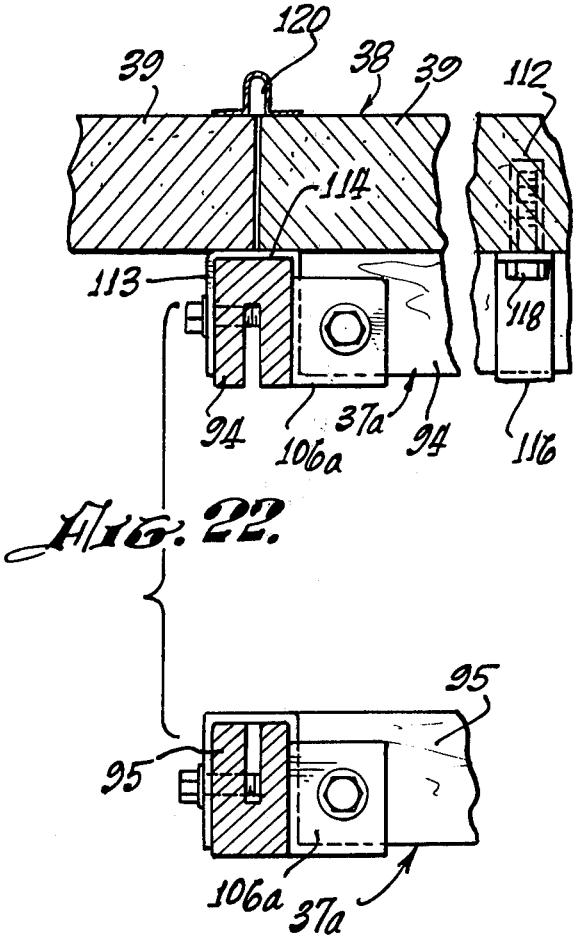
FIG. 22 is a view similar to FIG. 21, taken along the line 22—22 of FIG. 20.

Another preferred embodiment of roof truss according to this invention is shown in FIGS. 20 to 22 and illustrates application of the same principles to trusses utilizing wooden top and bottom chord members. In such usages, wooden members of appropriate length and cross-section are utilized for top and bottom chords 94, 95 respectively. The web is formed of angle iron, individual web members 96 being welded to gusset plates 97 in a zig-zag configuration to provide vertical end portions as at 96*a* and intermediate angular web links as best seen in FIG. 20.

Gusset plates 97 each comprise a rounded tab portion adapted to be received in an appropriate slit in either chord 94 or 95 as the case may be, and having an aperture 98 bored in said tab portion. The chord beams are provided with through bores at locations intended to receive gusset plates 97 and sleeves 99 are provided for rotational accommodation of a nut and bolt assembly 100 as best seen in FIG. 21. Such trusses are assembled by welding the web 96 to gusset plates 97 in an appropriate shape, as previously described, and then slitting the top and bottom chords to receive the gusset plates. Then, holes are bored in the beams, when desired, for accommodation of sleeves 99 and nut and bolt assemblies 100. The web and gusset assembly is then inserted into the slots in the beams, sleeves 99 positioned, and the nuts and bolts secured to complete the beam assembly.

As in the case of the metallic truss previously described, the wooden truss structure provides for pivotal adjustment at the beam chords to accommodate slight relative movement of building structure components without causing cracking or buckling of such components.

Certain of the truss elements may be provided with fins 102 attached to the underside of the bottom chord, as desired (see FIG. 19) for purposes to be described later.

THE ROOF TRUSS AND ROOF ASSEMBLY

Attention is directed to FIG. 2 which illustrates a typical assembly of roof trusses and of roof panels supported thereby. In the practice of the present invention roof trusses are supported on hangers or brackets welded or otherwise appropriately supported on the vertical columns previously described and provision is made for attachment of cross trusses as necessary, a typical arrangement being shown in FIG. 2. In general, main trusses are attached across the width of the building (26 feet in the exemplary case) at intermediate columns and from column to column (about 13 feet) at the building ends. Internal trusses 37*a* are utilized to support internal walls and for roof panel hold-down purposes and to complete the roof truss assembly. In connection with description of roof truss assembly it should be understood that the structures and techniques of the present invention permit a variety of exterior and interior wall arrangements. Thus, assuming a 10 foot exterior wall and an 8 foot ceiling, it is possible to mount the trusses sufficiently internally on the columns so that the outer wall panels may extend the full 10 feet, as shown in FIGS. 14 and 20. Alternatively, the exterior wall structure may be in 8 foot panels, secured at their tops to the underside of the trusses, which may be mounted on the columns closer to the outer edges thereof. In the latter case the 10 foot wall is completed by attachment of 2 foot skirt or truss cover sections to complete the exterior wall structure up to the roof (see FIG. 19).

A preferred embodiment of the mode of assembly of roof truss sections to the vertical columns is shown in FIGS. 14 to 18, illustrating the metallic truss chords of FIGS. 14 to 18 and an exterior wall which extends the full height of the vertical columns exteriorly of the trusses. Trusses 37 are supported at their ends by brackets or hangers 104 of an appropriate thickness and strength, preferably of steel, welded to the upright columns, as shown. At corner columns the hanger assembly is as shown in FIG. 16, with hangers for reception of chords which run the length of the building being welded to the column along the inner edge thereof, the hangers being of U-shaped configuration to receive the ends of the channel shaped chords. Similar hangers 105 are welded to hangers 104, perpendicularly disposed relative thereto, to support trusses perpendicularly disposed at the end walls of the structure. Intermediate vertical columns are provided with hangers welded along the inner edges of the columns along the wall line, as shown in FIG. 18 as well as similar hangers as at 106 welded to the inner surface of the column to provide support for interior wall trusses.

Each of the hangers 104, 105, 106 is provided with aligned apertures 108. The ends of the top and bottom truss chords are drilled with matching apertures and, in assembly, truss ends are positioned in hangers and secured by nut and bolt assemblies 110, as best shown in FIG. 14.

The overall truss assembly (see the example of FIG. 2) is assembled by positioning the long intermediate trusses and end wall trusses 37 in hangers 104, 105 previously welded to vertical columns 34. Internal trusses 37*a* are supported on similar hangers welded or otherwise secured to truss chords 87, 88 to form the completed truss structure. (See FIG. 26).

The alternative wooden chord truss structures of FIGS. 20 to 22 may be similarly attached to the vertical columns by securement in hangers as previously described. Thus, referring to FIG. 20, hangers 104*a*, 105*a* are welded together and to the corner column. Intermediate outer wall columns are provided with hangers welded on three sides, as previously described, and provision is made for attachment of internal cross trusses, as best shown in FIG. 22. For this purpose steel straps 113 are secured, as by heavy wood screws, to the chords of the main cross trusses, and for this purpose, the top surface of the top chords may be hollowed as at 114 so that the chords will be flush with the roof slab sections to be assembled to them. Straps 113 have hanger arms 106*a* welded thereto, as most clearly shown in FIG. 22, for support of internal trusses perpendicular to the main trusses.

While the novel principles of the present invention offer a wide range of variation, it should be noted that the dimensions chosen in the preferred example are such that exterior walls will be collinear with the vertical columns to provide smooth, coordinated exterior wall appearance. Obviously other arrangements are possible within the scope of the invention.

The roof slab 38 of the building structure of the present invention is comprised of a plurality of roof panels 39 which are prefabricated of light weight concrete of appropriate thickness and of dimensions to coincide with the roof truss assembly in the sense that the edges of individual panels and the roof truss arrangements are such that abutting edges of roof panel sections overlie internal truss elements to facilitate tying down of the roof slab and the tying together of the panels into a monolithic structure. In the example illustrated in FIG. 2, the roof truss assembly is such that the individual roof panels are identical in dimensions, as shown. In the 50 by 26 foot exemplary structure of FIGS. 1 and 2, individual roof panels would have dimensions of 13 by 5 feet. In the prefabrication of the roof panels, internally threaded sleeves 112 are embedded, as best shown in FIG. 15, 21 and 22, adjacent the edges thereof, at a suitable spacing, as for example on about 2 foot intervals. For tying down the roof panels, the upper chords of the roof trusses of either type of roof truss disclosed herein are provided with bracket elements 116. Such bracket elements are of steel, of appropriate thickness and strength and are of generally L-shaped configuration, providing a leg for engagement with the upper chord of a truss component and a leg for engagement with the underside of a roof panel. Each leg has an aperture for accommodation of fastening means for attachment respectively to the upper chords of the trusses and to the under side of the roof panels. The bracket elements 116 may coincide with a truss web bolt fastener 91, 92 as shown in FIGS. 14 and 15 or the equivalent fasteners 100, as in FIG. 20 so that the nut and bolt assembly in each case serves not only to secure the truss web in place, but also to tie adjacent roof panels together. The brackets 116 are secured to tie adjacent roof panels together. The brackets 116 are secured to the bottom sides of roof panels 39 by bolts 118 threaded into the threaded sleeves 112 of the roof panels.

Thus, after assembly of the entire roof truss and after installation of exterior walls, the roof may be assembled by positioning the individual roof panels over the truss assembly with panel edges coincideing with and overlying trusses. The panels are then secured to the trusses and tied to one another to form a monolithic roof slab by insertion and tightening of bolts 118. Brackets 116 are typically spaced at about 2 feet on centers to tie down the roof slab. FIGS. 15 and 21 most clearly show how adjoining slabs are tied together over roof trusses and also illustrate a mode of sealing the joints, as by attachment of expansion flashing 120 as joint covering means. Typically the roof panels are of dimensions to provide an overhang as at 122 (See FIGS. 1, 14 and 19 for sample) or to fit internally of the exterior wall as in FIG. 20. In either case the outer edges may be thickened and provided with ornamental flashing 46 if desired.

THE EXTERIOR WALLS

Figure 19:
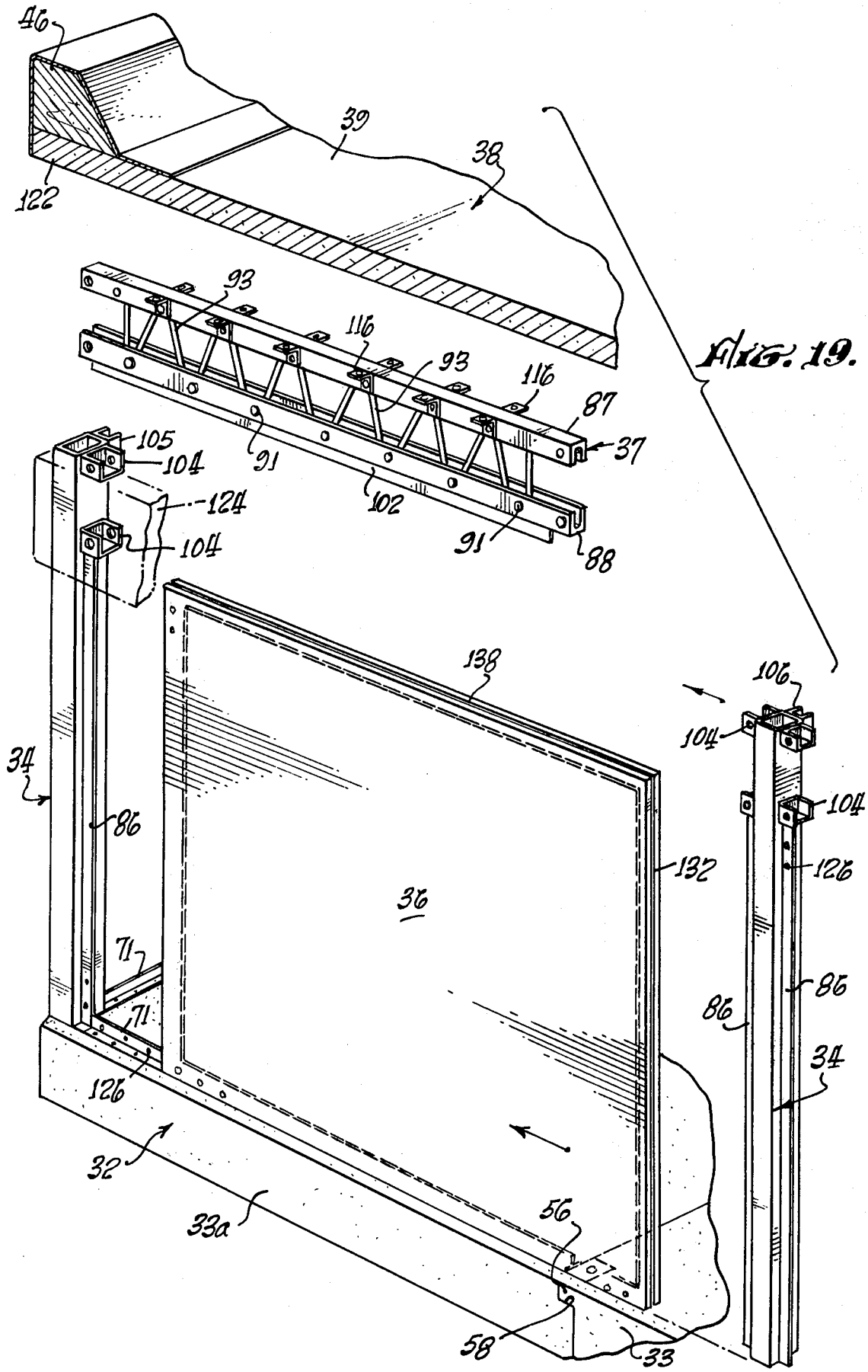
FIG. 19 is an exploded perspective view illustrating a modification of the FIG. 14 embodiment, involving metallic trusses and exterior wall structure which does not extend to the roof and in which a skirt is utilized to enclose the truss structure.

The prefabricated components of the building structures contemplated by the present invention permit variation of style and of exterior wall arrangement. Thus, it is possible to provide exterior walls which extend from floor slab to roof (typically 10 feet) and which enclose the roof truss assembly, with either the metallic chord truss embodiment (see FIGS. 14 to 18) or the wooden chord truss embodiment (see FIG. 20 to 22). Alternatively, exterior walls can be of a length to be secured, at their tops, to the undersides of the bottom chords of the exterior trusses, as shown in FIG. 19, typically about 8 feet. In the latter case, a skirt 124 is provided to slightly overlay the upper edge of the exterior wall panels to complete the exterior enclosure of the structure. Although such structure is shown in the drawings (FIG. 19) in connection with metallic chord truss structures, it is obviously equally as adaptable to the wooden chord truss structures disclosed herein. Moreover, within the scope of the present invention exterior walls may be either coincident with vertical column outer surfaces or not, as desired.

In connection with the variety of exterior wall arrangements discussed in the preceding paragraph it should be obvious that hanger elements 104, 105, 106 (FIGS. 14 to 19) or 104*a*, 105*a*, 106*a* (FIGS. 20 to 22) may be positioned, as desired, so that trusses either overhang exterior wall panels, as in the FIG. 19 example, or are positioned internally thereof as in FIGS. 14 and 20. Similarly, in either arrangement, disposition of the truss hangers and of exterior wall securement fins 71, 86 and 102 can be designed, at choice, to provide exterior walls indented from the exterior surfaces of vertical columns or collinear therewith, to provide a variety of possible decors. With the understanding that all such variations are within the scope of this invention, a structure will now be described in which full length (10 foot) exterior wall panels are provided and arranged to be collinear with the external surfaces of the vertical columns. Such description is appropriate to use with truss structures of either the metallic chord arrangement of FIG. 14 or the wooden chord arrangement of FIG. 20, since in either case the illustrated examples show hanger or bracket elements (104, 105, 106 or 104*a*, 105*a*, 106*a*) positioned so that the outer surface of the exterior wall panels are collinear with the outer surfaces of the upright columns 34.

Attention is now directed to fins 71 attached adjacent to the outer edges of floor panels 33, 33*a* and 33*b*, and to fins 86 attached to or forming a part of vertical columns 34, as previously described. The purpose of such fins is to position and serve as a means for securing exterior wall panels in place. For this purpose such fins are provided with spaced apertures 126.

Figure 23:
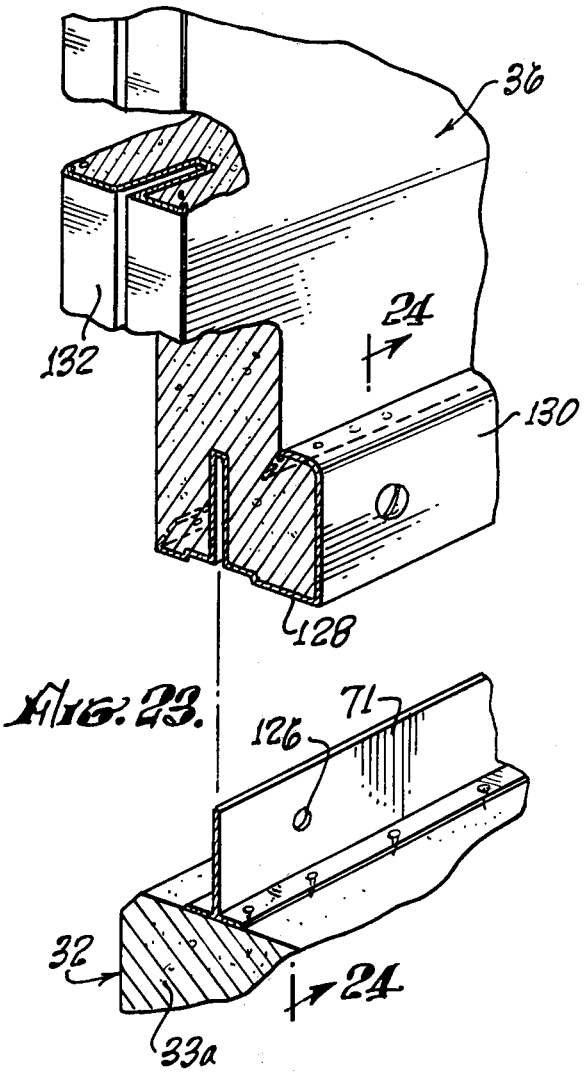
FIG. 23 is an enlarged exploded fragmentary perspective view illustrating details of exterior wall panel structure and of positioning and fastening means therefore.
Figure 24:
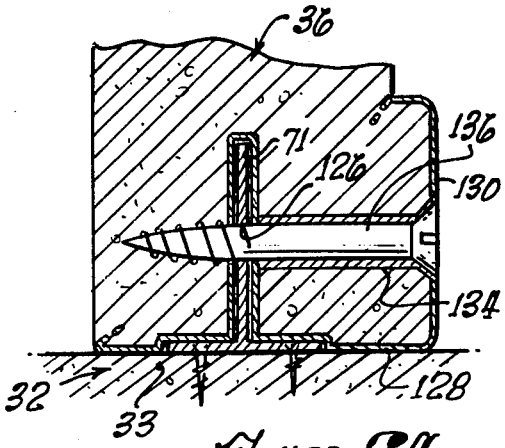
FIG. 24 is a further enlarged fragmentary section taken along the line 24—24 of FIG. 23.

Exterior wall panels are formed of light weight concrete of appropriate thickness and are provided with openings for windows 40, or doors 42 so that such details may be attached by any desired means. Attention is directed to FIGS. 23 and 24 for details of such exterior wall panels. At least the bottom and side edges are provided, in the molding of the panels, with slits complementary to fins 71 and 86. Such sheathing is clearly shown at 128, in FIG. 23, as applied to the bottom surfaces of exterior panels, and is shaped to provide a cavity, as necessary to accommodate the fin 71. The mode of connecting flanges of fin 71 to the floor slab 32 is clearly shown in FIGS. 23 and 24. The bottom of the interior surface of exterior wall panels may be thickened and sheathing 128 extended around the thickened portion and embedded in the concrete to form a prefabricated baseboard, as shown at 130. Similarly, side edges of the exterior wall panels are provided with embedded metal sheathing, as at 132 to provide slots adapted to receive fins 86 on vertical columns 34. Sheathing strips 128 and 132 preferably form parts of the molds in the molding of the concrete wall panels.

The bottom and side edges of the wall panels are provided with means to permit fastening to fins 71, 86, as by threaded fasteners engaged in the bolt holes 126 previously described. For this purpose, preferably, the sheathing strips may be provided with integral sleeves, as at 134 (FIG. 24) arranged to receive self threading screws 136. Sleeves 134 are positioned to align with apertures 126 upon assembly and are shaped to accommodate counter-sunk screw heads. The screws 136 are of a length to penetrate the fins but not the exterior surface of the wall panel, thus preserving weather tightness and the appearance of the exterior wall.

From the foregoing, various methods of assembly of exterior walls should be obvious. Thus, one mode of assembly is to attach a single vertical column 34 to the floor slab, position a panel to one side of that column with the matching side edge of the panel containing and secured to the fins 86 and the bottom slit of the panels engaging and secured to the fins 71 extending upwardly from the floor slab. The next vertical column is then attached to the floor slab with a fin 86 engaged in the matching slit in the previously positioned wall panel and screws 136 inserted. This procedure may be followed entirely around the building with the last wall panel being slid into place from above. In this connection it should be understood that fins 71 and 86 and the slots in the wall panel are proportioned to position the wall panel as desired, in this example flush with the exterior surface of the vertical columns.

Alternatively, in such arrangements, all of the vertical columns can be first positioned and secured and the wall panels all positioned from above by sliding them into fins 86 and 71.

In such structures, involving exterior walls which can enclose the entire roof truss assembly, it should be apparent that the roof truss may be assembled either before or after erection of the exterior walls.

Attention is directed to FIG. 19, illustrating application of the principles of the invention to a structure in which the exterior walls extend only to the bottom of the trusses. In such an arrangement, the brackets or hangers 104 and fins 71, 86 and 102 are positioned so that the exterior of the wall panels is disposed as desired. In the example of FIG. 19 the arrangement is such that the exterior surfaces of wall panels will be flush with the exposed sides of the vertical columns, although, obviously, within the scope of this invention, other arrangements may be readily designed. In this arrangement, the exterior walls must first be assembled and fastened to the floor panels and vertical columns by the procedure previously described. The roof trusses are then assembled, exterior trusses being provided with fins 102 for engagement in complementary slots 138 provided in the top edges of the wall panels as is clearly shown in FIG. 19. Upon insertion of screws 136 through sleeves 134 and apertures 126 to connect the top edge of the wall panel to fins 102 the wall panels are completely secured. A prefabricated light-weight concrete skirt 124 is then attached externally of the trusses (see FIG. 19) by any suitable means, as by threaded fasteners extending through exterior truss chords into the material of the skirt.

INTERIOR WALLS AND CEILINGS

Figure 25:
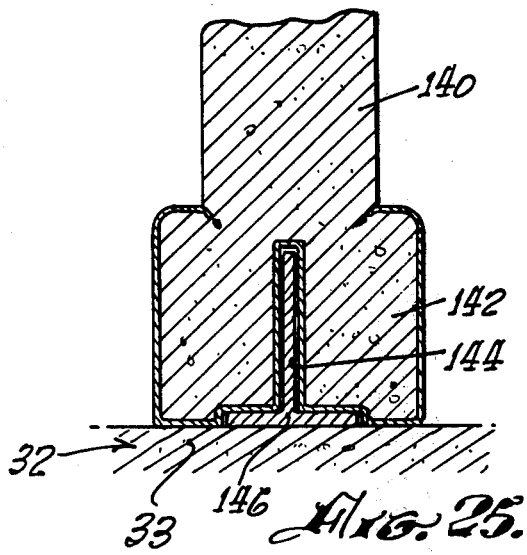
FIG. 25 is an enlarged fragmentary section illustrating an interior wall detail.

This invention is particularly concerned with fully prefabricated novel, improved building systems as they relate to the external building shell, it being recognized that internal walls and ceilings may be positioned and hung by conventional means. However, the drawings (FIGS. 25 and 26) illustrate interior wall and interior wall securement means which are particularly adapted for cooperative use with the novel structure of this invention in that they provide for a degree of accommodation for slight movement of roof trusses. According to the present invention, interior walls 140 may be molded of suitable material and be provided with thickened bottoms and pre-embedded baseboards as at 142, all as shown in FIG. 25. The stripping which provides the baseboard external finish is shaped to provide a T-shaped cavity as at 144 to cooperate with mounting strips or fins 146 (similar to fins 71 previously described) which may be "shot" into the floor slab in desired locations.

Figure 26:
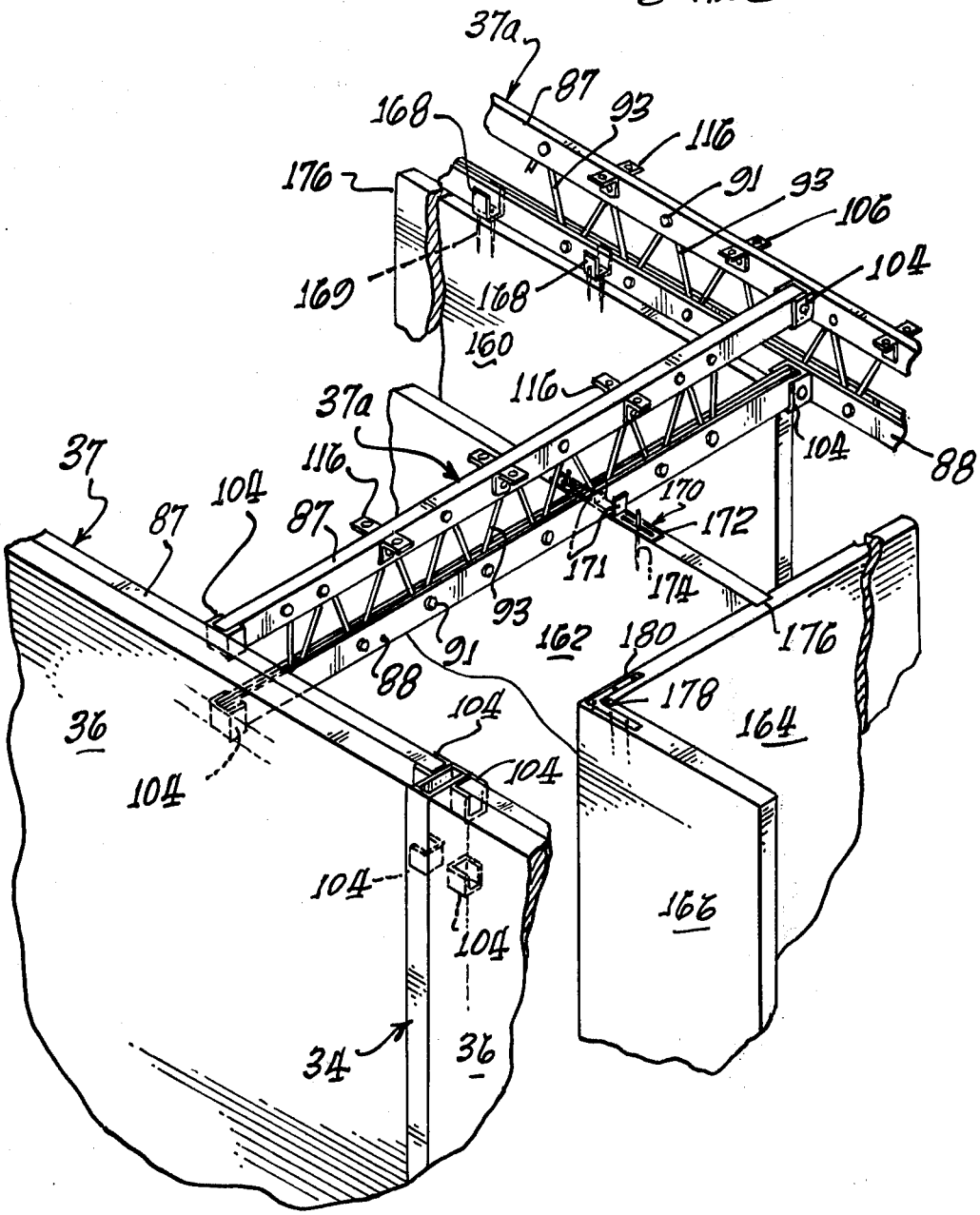
FIG. 26 is a fragmentary perspective view illustrating methods for interior wall attachment to the roof trusses of the present invention.
Figure 27:
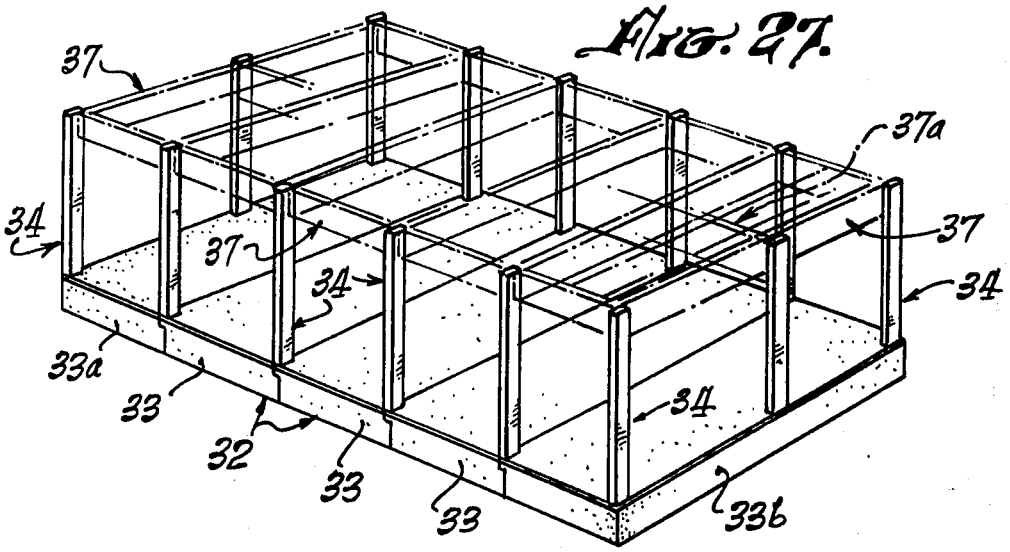
FIG. 27 is a schematic showing of the shell of the house of FIG. 1 illustrating the roof truss arrangement thereof.

Attention is now directed to FIG. 26, which is a fragmentary exploded perspective view, particularly illustrating preferred means for attachment of variously disposed interior walls to the roof trusses of the preferred embodiment of the invention. The arrangement shown in the example is the roof truss and external wall disposition of FIG. 14, it being understood that the bottoms of all interior walls may be secured as previously described.

For cooperation with the external building components previously described, which are provided with means permitting a degree of movement to minimize danger of cracking or buckling, the interior walls, which may be entirely prefabricated, may be related to the roof trusses in manners providing freedom for movement relative to the roof trusses.

Typically, all interior walls are formed to provide about 1 inch of clearance between the upper edges of the walls and the bottoms of the trusses and have pin connections with the trusses which will permit a degree of vertical adjustment and a degree of movement along the length of the walls.

As examples, in FIG. 26, the wall 160 is an interior wall underlying and collinear with an interior roof truss. The wall 162 is an interior wall which crosses perpendicularly under an interior roof truss. Walls 164 and 166 are typical of other internal walls and are included to illustrate corner and abutting internal wall arrangements.

Walls such as the wall 160 are related to overlying collinear roof trusses by nailing U-shaped anchor clips 168 into the upper edge surface of the wall, as shown, at appropriately spaced intervals. The wall is then tipped into place with the lower chord of the truss slidably engaged within the clips. In such arrangements walls such as the wall 160 are able to accommodate slight movement relative to roof trusses, vertically as well as along their length. Alternatively, such trusses may be provided with fins 102 as previously described for engagement in slots in the top edges of such walls.

Similarly, walls such as the wall 162, which cross under roof trusses perpendicularly, are related to such roof trusses by anchor clips 170 of an H-clamp type. Clips 170 comprise upstanding flanges 171 adapted to be attached to the bottom chord 88 of a truss and having slotted wing portions 172. A wall such as wall 162, having about 1 inch of clearance under the roof truss, is positioned as desired, in alignment with the wing portion of anchor clip 172 and pins 174 driven through the slots into the top edge of the wall, serve to establish the position of the top of the wall relative to the truss. In such an arrangement the interior wall 162 can accommodate movement relative to the roof truss either vertically or along the length of the wall. The ends of all interior walls, as they abut one another or an exterior wall perpendicularly, may be mortised, as at 176, and corners may be dovetailed as at 178 and secured by L-straps 180.

From the foregoing detailed description it may be seen that the objects of this invention are achieved by the cooperative interrelationship of novel components including improved floor slabs, vertical columns, truss structures, external and internal walls and roof panel structures which provide building structural systems which are substantially entirely prefabricated and which minimize costs of on-site labor and construction. They are advantageous over prior art pre-fabricated and even prior art conventional building structures in that they are fireproof, termite proof, shock and flood resistant and in that they provide structures of improved life expectance which can be very economically constructed.

The structures described herein are adapted to the use of conventional methods and materials in the finishing off of the structure. Thus the outer surfaces of the exterior wall panels may be finished with paint, stone, brick, marble, wood or other desirable material in conventional manner. Similarly the interior surfaces may be finished conventionally, as with paint, wood panel, wallpaper, or the like and floor and roof surfaces may be conventionally treated.

It should be understood that although several specific preferred embodiments of the invention have been illustrated herein it is not intended that this invention should be limited to such examples or to any specific dimensions or materials. Numerous substitutions, modifications and alterations are all permissible without departing from the spirit and scope of the invention is defined in the following claims.

What is claimed is:

1. A prefabricated building structure comprising a floor slab assembly, a plurality of vertical columns, means for attaching the lower ends of said columns to said floor slab assembly, and a roof truss assembly attached to and supported by said columns and adapted to support and tie down a roof slab assembly, and means permitting movement of said floor slab assembly, said roof truss assembly and said vertical columns relative to one another in response to slight building movements due to shock, settling or the like.

2. A prefabricated building structure according to claim 1, wherein said means comprises means for pivotally attaching the lower end of said columns to said floor slab assembly, said last mentioned means including resilient means to permit limited pivotal movement of the vertical columns relative to the floor slab assembly whereby slight relative movement may occur, rather than cracking, buckling or warping of building components, in accommodating for slight building movements due to shock, settling or the like.

3. A prefabricated building structure according to claim 1 wherein said means comprises a plurality of roof trusses forming said roof truss assembly, each said truss being comprised of top and bottom chords, said top and bottom chords being pivotally attached to said columns, web means interposed between said top and bottom chords and means for pivotally attaching said web means to said top and bottom chords, said last named means permitting pivotal movement of said web relative to said chords and said columns, whereby slight relative movement of said chords and web relative to one another may occur rather than cracking, buckling, or warping in accommodating for slight building movements due to shock, settling or the like.

4. A prefabricated building structure comprising a prefabricated floor slab assembly, a plurality of vertical columns resiliently mounted at their lower ends to said floor slab assembly, a roof truss assembly attached to and supported by said vertical columns and adapted to support and tie down a roof slab, said roof truss assembly being comprised of a plurality of roof trusses, each said roof truss comprising a top chord member and a bottom chord member and a web element pivotally attached to and interposed between said top and bottom chord members, each of said chord members being pivotally attached at each of its ends to a vertical column, whereby said vertical columns and said chord members may have slight movement relative to one another in response to slight building movements due to shock, settling or the like.

5. A prefabricated building structure according to claim 1 wherein said floor slab assembly comprises a plurality of prefabricated floor panels assembled and secured together to form a monolithic floor slab and adapted to be attached to suitable supporting piers.

6. A prefabricated building structure according to claim 5, further comprising a plurality of prefabricated piers placed in appropriate footings and in a pattern to support said floor panels at the junctures of the interior matching edges thereof and adjacent the outer peripheral edges thereof, and means to attach said floor panels to said piers.

7. A prefabricated building structure according to claim 6, wherein said floor panels are of reinforced concrete and wherein each panel has a thickened beam portion along those edges which comprise the periphery of the assembled floor slab, said thickened beam portions extending downwardly and being supported by said piers with the bottoms of said beam portions substantially at ground level to provide an air space under the building structure.

8. A prefabricated building structure according to claim 6 wherein said prefabricated piers are of a length to extend sufficiently into the ground whereby the footings poured to anchor said piers may be below frost and surface water levels.

9. A prefabricated building structure according to claim 6, wherein said means to attach said floor panels to said piers comprise screw threaded rods threadedly engaged within each of said piers and extending through floor panels supported by said piers, and nut means threaded onto said rods to secure the floor panels to the piers.

10. A prefabricated building structure according to claim 9 wherein said floor panels are of reinforced concrete and wherein each panel has a thickened beam portion along those edges which comprise the periphery of the assembled floor slab, said thickened beam portions extending downwardly and being supported by said piers at the outer ends of said floor slab assembly and at the junctures of the matching interior edges of adjacent floor panels, said matching edges being provided with cooperating surfaces to provide cylindrical passages at said matching edges to accommodate said threaded rods whereby each of said nut means secures the edges of two adjacent floor panels to the supporting pier.

11. A prefabricated building structure according to claim 10 wherein said beam portions at the outer ends of the floor slab assembly are provided with cylindrical passages to accommodate said threaded rods extending from the piers underlying said beam portions at the outer ends of the floor slab.

12. A prefabricated building structure according to claim 2 wherein each of said vertical columns is of tubular metallic construction, the lower end thereof including a resilient pad secured therein and means extending through said resilient pad for resiliently mounting said column to said floor slab assembly.

13. A prefabricated building structure according to claim 11 wherein each of said vertical columns is of tubular metallic construction, the lower end thereof including a resilient pad therein and bearing plate secured internally of the column above said resilient pad, said screw threaded rods extending through said resilient pad and said bearing plate whereby said nut means resiliently secures said column to the floor panels as well as securing the floor panels to the piers.

14. A prefabricated building structure according to claim 13 wherein each of said floor panels is provided with apertured anchor plates embedded therein adjacent the matching and outer edges thereof, with the apertures overlying said cylindrical passages, said anchor plates being of a size and configuration to be received closely within and to engage the inner walls of said vertical columns to position and align said columns.

15. A prefabricated building structure according to claim 1, having a plurality of prefabricated exterior wall panels, at least some of said wall panels being attached at their bottom edges to said floor slab assembly and at their side edges to vertical columns.

16. A prefabricated building structure according to claim 15 wherein at least some of said attached wall panels are attached at their upper edges to said roof truss assembly.

17. A prefabricated building structure according to claim 15 further having internal walls and means tying the upper edges of said walls to said roof truss assembly, said last mentioned means providing for relative movement of said roof truss assembly and the said internal walls.

18. A prefabricated floor slab assembly for building structures comprising a plurality of prefabricated floor panels assembled together to form a monolithic floor slab and a plurality of prefabricated piers, placed in prepared holes in the ground to support said assembled floor panels at the junctures of the interior matching edges thereof and adjacent the outer peripheral edges thereof, and means to secure said floor panels to said piers.

19. A prefabricated floor slab assembly according to claim 18 wherein said floor panels are of reinforced concrete and wherein each panel has a thickened beam portion along those edges which comprise the periphery of the assembled floor slab, said thickened beam portions extending downwardly and being supported by said piers with the bottoms of said beam portions substantially at ground level to provide an air space under the building structure.

20. A prefabricated floor slab assembly according to claim 18 wherein said prefabricated piers are of a length to extend sufficiently into the ground whereby the footings poured to anchor said piers may be below frost and surface water levels.

21. A prefabricated floor slab assembly according to claim 18 wherein said means to attach said floor panels to said piers comprise screw threaded rods threadedly engaged within each of said piers and extending through floor panels supported by said piers, and nut means threaded onto said rods to secure the wall panels to the piers.

22. A prefabricated floor slab assembly according to claim 22 wherein said floor panels are of reinforced concrete and wherein each panel has a thickened beam portion along those edges which comprise the periphery of the assembled floor slab, said thickened beam portions extending downwardly and being supported by said piers at the outer ends of said floor slab assembly and at the junctures of the matching interior edges of adjacent floor panels, said matching edges being provided with cooperating surfaces to provide cylindrical passages at said matching edges to accommodate said threaded rods whereby each of said nut means secures the edges of two adjacent floor panels to the supporting pier.

23. A vertical column for building structures comprising a tubular metallic column, the lower end of said column including a resilient pad, a bearing plate welded interiorly of said column to position said resilient pad, said plate and pad having openings therethrough adapted to receive a stud for resiliently attaching the column to a horizontal building surface.

24. A vertical column according to claim 23 further characterized in that the lower surface of said resilient pad is spaced from the end of the tubular column to provide a pocket adapted to receive a positioning and anchoring member on said building surface.

25. A roof truss comprising top and bottom chords, said top and bottom chords having means at their ends for pivotal attachment to the vertical columns of a building structure, web means interposed between said top and bottom chords and means for pivotally attaching said web means to said top and bottom chords whereby, when said truss is positioned in a building structure truss assembly, slight relative movement of said chords and web relative to one another may occur in accommodating slight movements of building components.

26. A roof truss according to claim 25 wherein said top and bottom chords are each comprised of channel form metal.

27. A roof truss according to claim 26 wherein said rod and said chords are of steel.

28. A roof truss according to claim 25 wherein said chords are of wood.

29. A roof truss according to claim 26 wherein said channel forms chords are disposed in spaced relationship with the channels facing one another and said web comprise a single length of metal rod bent into a zig-zag configuration, the points formed by said zig-zag configuration being alternately pivotally connected in the channels of said top and bottom chords.

30. A roof truss according to claim 28 wherein said web comprises a plurality of metallic links welded to spaced gusset plates in a zig-zag configuration, said top and bottom chords being spaced apart and having slots in their facing surfaces, said gusset plates being alternately pivotally connected in said slots in said top and bottom chords.

31. A roof truss according to claim 30 wherein said links are of angle iron.

* * * * *

UNITED STATES PATENT OFFICE
CERTIFICATE OF CORRECTION

PATENT NO. : 4,001,990

DATED : January 11, 1977

INVENTOR(S) : WILLIAM P. CHASE and LEON HOLLOSCHUTZ

It is certified that error appears in the above-identified patent and that said Letters Patent are hereby corrected as shown below:

COLUMN 8: line 62, "such" should be --each--

COLUMN 18: line 9, "22" should be --21--

Signed and Sealed this

Twenty-first Day of June 1977

[SEAL]

*Attest:*

RUTH C. MASON
*Attesting Officer*

C. MARSHALL DANN
*Commissioner of Patents and Trademarks*